US009890792B2

(12) United States Patent
Tarnowski et al.

(10) Patent No.: US 9,890,792 B2
(45) Date of Patent: Feb. 13, 2018

(54) RADIAL OR MIXED-FLOW COMPRESSOR DIFFUSER HAVING VANES

(71) Applicant: TURBOMECA, Bordes (FR)

(72) Inventors: Laurent Tarnowski, Pau (FR); Nicolas Pascal Bulot, Assat (FR)

(73) Assignee: TURBOMECA, Bordes (FR)

( * ) Notice: Subject to any disclaimer, the term of this patent is extended or adjusted under 35 U.S.C. 154(b) by 221 days.

(21) Appl. No.: 14/780,881

(22) PCT Filed: Mar. 25, 2014

(86) PCT No.: PCT/FR2014/050693
§ 371 (c)(1),
(2) Date: Sep. 28, 2015

(87) PCT Pub. No.: WO2014/154997
PCT Pub. Date: Oct. 2, 2014

(65) Prior Publication Data

US 2016/0053774 A1 Feb. 25, 2016

(30) Foreign Application Priority Data

Mar. 28, 2013 (FR) ..... 13 52829

(51) Int. Cl.
*F04D 29/44* (2006.01)
*F04D 17/12* (2006.01)

(52) U.S. Cl.
CPC ..... *F04D 29/444* (2013.01); *F04D 17/12* (2013.01)

(58) Field of Classification Search
CPC ..... F04D 29/44; F04D 29/441; F04D 29/444; F04D 29/242; F04D 17/12
See application file for complete search history.

(56) References Cited

U.S. PATENT DOCUMENTS 3,298,636 A * 1/1967 Arnholdt ..... B64C 21/02 244/198
5,395,071 A * 3/1995 Felix ..... B64C 3/14 244/200

(Continued)

FOREIGN PATENT DOCUMENTS

EP 2299124 3/2011
EP 2402558 1/2012

(Continued)

OTHER PUBLICATIONS

International Search Report with English Language Translation, dated Jul. 14, 2014, Application No. PCT/FR2014/050693.

(Continued)

*Primary Examiner* — Igor Kershteyn
*Assistant Examiner* — Eric Zamora Alvarez
(74) *Attorney, Agent, or Firm* — Blakely Sokoloff Taylor & Zafman LLP

(57) ABSTRACT

The invention relates to a vane (10) of a diffuser (5) for a radial or mixed-flow compressor (2) of an engine (1), including a leading edge (11) arranged facing a flow of gas, a trailing edge (12) being opposite the leading edge (11), a side upper surface wall (13) and a side lower surface wall (14) which connect the leading edge (11) to the trailing edge (12), and a profile including a curved line (15) having at least two points of inflection (I1, I2) between the leading edge (11) and the trailing edge (12). The invention also relates to a corresponding radial diffuser (2).

11 Claims, 3 Drawing Sheets

(56) References Cited

U.S. PATENT DOCUMENTS

| | | | | |
|---|---|---|---|---|
| 2011/0255962 | A1* | 10/2011 | Porodo | F04D 29/682<br>415/208.1 |
| 2011/0314808 | A1* | 12/2011 | Mohamed | F01D 5/141<br>60/602 |
| 2012/0230834 | A1* | 9/2012 | Cornelius | F01D 5/141<br>416/243 |

FOREIGN PATENT DOCUMENTS

| | | |
|---|---|---|
| JP | 2011252424 | 12/2011 |
| WO | WO-2011128587 | 10/2011 |
| WO | WO-2012019650 | 2/2012 |

OTHER PUBLICATIONS

French Search Report, dated Dec. 11, 2013, French Application No. 1352829.

* cited by examiner

RADIAL OR MIXED-FLOW COMPRESSOR DIFFUSER HAVING VANES

FIELD OF THE INVENTION

The invention relates generally to gas turbine engines, and more particularly to a diffusion stage of a radial or mixed-flow compressor of a gas turbine, as well as to an associated compressor.

TECHNOLOGICAL BACKGROUND

A compressor includes one or more rotating discs (rotor or wheel), bladed or not, and one or more wheels with fixed vanes (straightener stages).

A radial (or centrifugal) compressor has at least one radial compressor stage, that is capable of achieving a flow of gas perpendicular to the central axis of the compressor. It includes at least one wheel with radial blades which aspirate the air axially which, under the influence of the radial force, is accelerated, compressed and driven out radially. This air is then straightened in a diffuser (fixed vanes) which transforms part of its speed into static pressure by slowing the gases leaving the wheel. The operation must take place with a minimum of total pressure loss while still maintaining a satisfactory level of stability of the compressor so as to maintain an acceptable surge margin for operation of the turbomachine.

The gases are then guided toward the combustion chamber.

A mixed-flow (or axial-radial) compressor has at least one compression stage diagonal with respect to said central axis, so that the fluid leaves the wheel of the compressor forming a nonzero angle with the radial direction.

A diffuser of a radial compressor consists of a wheel made up of two flanges between which the gases flow radially or diagonally from the center toward the periphery. Vanes are distributed between the flanges along the entire wheel. These vanes form a flow cascade between the leading edges of these vanes and the trailing edges.

However, deflection of the air flow leaving the wheel by the vanes of the diffuser can cause separation of the fluid on the intrados or the extrados of the vanes, which separation, if it is considerable, can lead to stalling of the fluid and, as a result, of pumping. It is known that this pumping phenomenon is harmful to the elements constituting the compressor, so that one seeks to avoid it to the extent possible.

Usually, the vanes of the diffuser consist of an intrados wall and an extrados wall with a circular arc shape, and include a quasi-linear right angle. An example of such a vane is illustrated in FIG. 1. However, these vanes have a limitation in terms of diffusing capacity. Indeed, an increase in diffusion by these vanes causes a drop in isotropic efficiency and an increase in the instability of the compressor.

A diffuser for a radial compressor including vanes conforming to the preamble of claim 1 was proposed in document WO 2012/019650. In particular, this document describes vanes the profile whereof has a camber line defined by a function having an inflection point. For this reason, the camber line has an "S" shape and makes it possible to distribute loads along the profile of the vane, with a low loading in the area of the leading edge, which increases progressively up to the inflection point of the vane, where it is a maximum. However, the use of such a vane showing such an "S" profile requires limiting the cross-section at the diffuser throat (that is at the fluid entry cross-section). This has the effect of shifting the Flow rate/Rate characteristic toward lower flow rates, and reduces the aerodynamic choking flow of the diffuser.

Vanes with a profile curve similar in shape to an "S" have also been described in document JP 2011-252424. In particular, the vanes of this document are configured so that an angle formed between the line of curvature and the circumferential profile curve rises, then drops, then rises again between the leading edge and the trailing edge of the vane. Here too, the cross-section at the diffuser's throat must therefore be limited, which has the effect of reducing the stability of the diffuser.

SUMMARY OF THE INVENTION

One objective of the invention is to improve the performance and the surge margin of the diffusers of radial and mixed-flow compressors of the prior art.

In particular, the invention has the objective of proposing a diffuser for a radial or mixed-flow compressor capable of limiting the isentropic efficiency drop of the compressor and of improving the capacity to slow down and to straighten the flow delivered by the wheel of the compressor while still maintaining the stability of the flow.

For this purpose, the invention proposes a vane for a diffuser for a radial or mixed-flow compressor, including a leading edge positioned facing a gas flow, a trailing edge positioned opposite to the leading edge, an intrados side wall and an extrados side wall which connect the leading edge and the trailing edge. The profile of the vane includes a camber line having at least two inflection points between the leading edge and the trailing edge. Furthermore, the curve of the intrados wall and the curve of the extrados wall substantially follow the curve of the camber line, so that:

the intrados wall includes, between the leading edge and the trailing edge, at least two convex parts separated by a concave part, and the extrados wall includes, between the leading edge and the trailing edge, at least two concave parts separated by a convex part, and the profile defines a chord line which extends between the leading edge and the trailing edge, and the convex parts of the intrados wall and the concave parts of the extrados wall extend at least partially on the same side of said chord line.

The invention also proposes a diffuser including at least one vane as described above, as well as a radial or mixed-flow compressor including such a diffuser, and an engine including such a compressor.

BRIEF DESCRIPTION OF THE DRAWINGS

Other features, aims and advantages of the present invention will be more apparent upon reading the detailed description hereafter, and with regard to the appended drawings given by way of non-restricting example and wherein.

DETAILED DESCRIPTION OF AN EMBODIMENT

A radial diffuser according to the present invention is in particular designed to be used with a radial or mixed-flow compressor 2.

Figure 4:
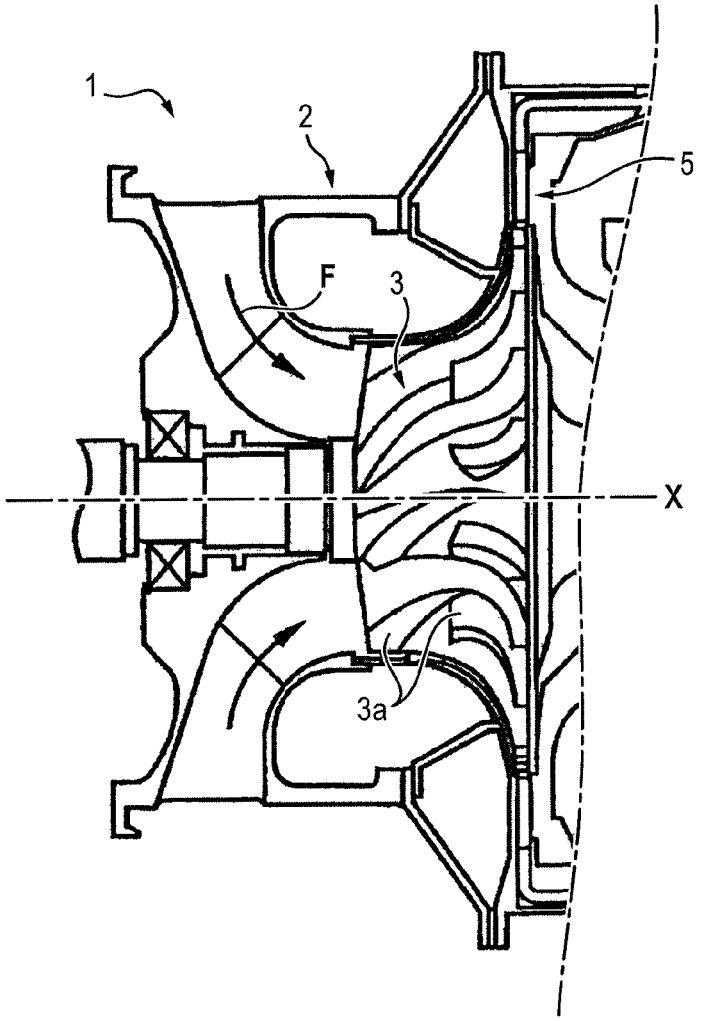
FIG. 4 illustrates an example of an engine which can include a diffuser conforming to the invention.

FIG. 4 is a partial section of an engine 1 comprising a radial compressor 2. A gas flow F is first aspirated into an air entry channel, then compressed between the blades 3*a* of a wheel 3 of the radial compressor 2 and its casing. The compressor 2 has axial symmetry about an axis X. The compressed gas flow F then exits radially from the wheel 3. If the compressor 2 were of mixed-flow type, the gas flow would exit inclined at a nonzero angle with respect to a direction radial to axis X.

The compressed air exits the wheel 3 radially while still having angular momentum, and passes into diffuser 5. The role of the diffuser is to convert part of the kinetic energy of the gases coming from the compressor 2 into static pressure by slowing the speed of the gases, and to straighten the flow exiting the wheel 3. It includes for this purpose a plurality of vanes 10 positioned along its circumference, which extend between a forward flange 5*a* and a rear flange 5*b*. Each of the vanes 10 has, in known fashion, a leading edge 11 positioned facing a flow of gas, a trailing edge 12 opposite to the leading edge 11, an intrados side wall 13 and an extrados side wall 14 which connect the leading edge 11 to the trailing edge 12.

The front 5*a* and rear 5*b* flanges can be planar. As a variant, one at least of the flanges 5*a*, 5*b* can include, in the space that they define between them, at least one area with alternating curvature between two vanes 10, so that the air stream can include adaptive tip and root meridians. Reference can be made to document FR 2 976 633 by the Applicant for more detail about the front 5*a* and/or rear 5*b* flanges having such an alternating curvature.

According to yet another variant, flanges 5*a*, 5*b* can have adaptive axisymmetric shapes.

Moreover, the front 5*a* and rear 5*b* flanges can be adapted to as to allow aspiration and blowing in the diffuser 5.

At least one of the vanes 10 of the diffuser 5, preferably all the vanes 10, includes, from upstream to downstream in the gas flow direction:

a first area, called a collection area, the shape whereof is configured to adapt to the upstream flow, and a second area, called the diffusion area, the shape whereof is configured to more strongly straighten the flow coming from the collecting area, so as to obtain a greater static pressure leaving the diffuser 5 and facilitate the feeding of the downstream part, generally an axial diffuser 5.

The vane 10 includes a profile, of which the camber line 15 has at least two inflection points I1, I2 between its leading edge 11 and its trailing edge 12, that is at least two changes in concavity.

Hereafter, the term "inflection point" will be understood to mean a point in a curve at which the curve crosses over its tangent. Moreover, the profile of the vane 10 is understood to mean a cross-section of the vane 10, that is a section of the vane 10 in a plane generally perpendicular to the extrados 13 and the intrados 14 of the vane 10. Finally, the "camber line 15" of the profile corresponds to the fictitious line which includes all the points equidistant from the extrados 13 and the intrados 14 of the vane 10, while the "chord 16" corresponds to the segment which has as its ends the leading edge 11 and the trailing edge 12.

The inflection points I1, I2 together delimit the collection area, which includes the part of the vane 10 extending upstream of the first inflection point I1, and the diffusion area, which includes the part of the vane 10 extending downstream of the inflection point I2.

Preferably, so as to optimize the stability of the diffuser 5 and the static pressure at the output of the diffuser 5, the inflection points I1, I2 are located between 10% and 90% of the chord 16, preferably between 30% and 70%. For example, the first I1 of the inflection points can be located between 35% and 55% of the chord 16, while the second inflection point I2 is located between 55% and 65% of the cord 16. The inflection points I1, I2 can in particular be disposed symmetrically with respect to the center of the chord 16.

As a variant, the profile of the vane 10 can include additional inflection points I1, I2.

Thus, the camber line 15 has successively, between the leading edge 11 and the trailing edge 12, at least a first concavity, a second concavity different from the first concavity, then a third concavity. When the inflection points I1, I2 are symmetrical with respect to the center of the chord 16, the second concavity is then centered in the vane 10.

According to one embodiment, the intrados wall 14 and the extrados wall 13 substantially follow the curve of the camber line 15, and therefore have as many inflection points I1, I2.

Figure 1:
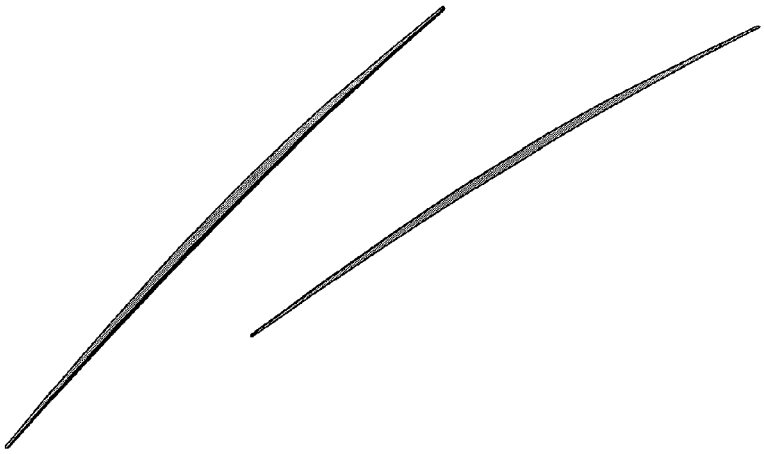
FIG. 1 illustrates an example of a vane profile conforming to the prior art.
Figure 2:
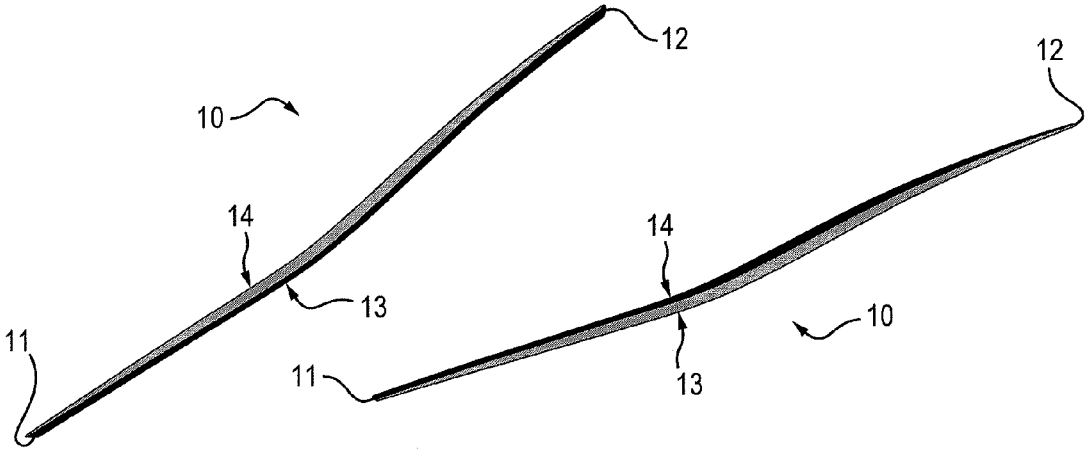
FIG. 2 illustrates an example of a vane profile of a diffuser conforming to the invention.
Figure 3:
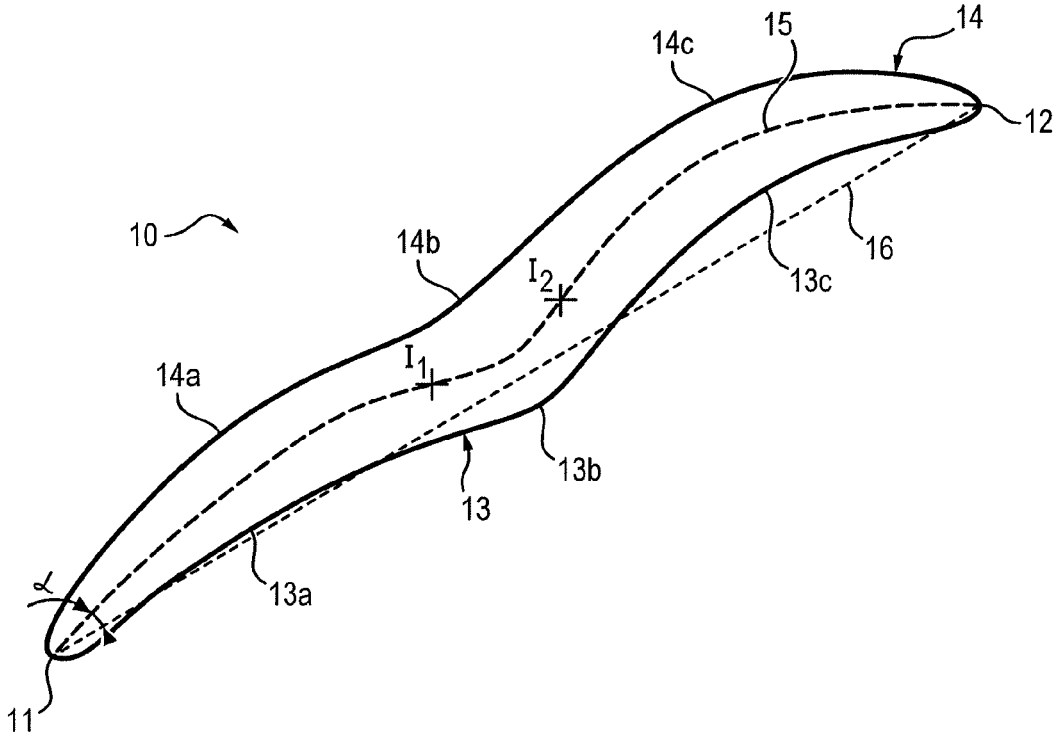
FIG. 3 is a detail view of a vane of FIG. 2, on which is shown a chord line and a vane median line.

In the embodiment shown in FIGS. 2 and 3, the intrados wall 14 and the extrados wall 13 thus include two inflection points I1, I2. The intrados wall 14 includes a convex part 14*a* between the leading edge 11 and the first inflection point, then a concave part 14*b* between the two inflection points I1, I2, then a convex part 14*c* between the second inflection point and the trailing edge 12. The extrados wall 13, for its part, includes a concave part 13*a* between the leading edge 11 and the first inflection point, then a convex part 13*b* between the two inflection points I1, I2, then a concave part 13*c* between the second inflection point and the trailing edge 12.

Moreover, the camber line 15 extends between the intrados wall 14 and the chord 16. In other words, at all points between the leading edge 11 and the trailing edge 12, the camber line 15 and the intrados wall 14 extend remotely from the chord 16. In addition, the concave areas of the extrados wall 13 cross the chord 16 and are therefore found at least in part on the same side of the camber line 15 as said chord 16.

Thanks to this configuration, made possible by the two inflection points I1, I2 of the camber line 15, the leading edge 11 and the trailing edge 12 are oriented in the same general direction with respect to the gas flow as that usually encountered in conventional diffusers 5, which makes it possible to preserve the cross-section of the throat, that is the fluid entry cross-section between two adjoining vanes 10. In this manner, the stability of the diffuser 5 is maintained while still improving diffusion of the flow.

The angle of attack $\alpha$ (which corresponds to the angle between the tangent to the camber line 15 at the leading edge 11 and the chord 16) can be substantially identical to that of conventional vanes 10. For example, the angle of attack $\alpha$ can be comprised between about 0° and about 45°. In this manner, it is possible to retain substantially the shape of the vanes 10 of conventional diffusers 5 in their collection area, which makes it possible to preserve the stability of the flow. Moreover, the presence of the second inflection point I2 makes it possible to modify the shape of the vanes 10 in their diffusion area to increase the efficiency of the diffuser 5, without thereby changing the shape of the collection area. Indeed, it is at present possible to increase the angle between the camber line 15 at the trailing edge 12 and the chord 16, independently of the shape of the collection area, which makes it possible to more strongly straighten the gas flow and thereby increase the static pressure and the total pressure rate at constant temperature rise at the output of the diffuser 5, and to therefore improve the isotropic efficiency of the diffuser 5 while still maintaining the surge margin and thus the stability of the compressor 2.

As stated previously, the camber line 15 of the profile of the vane 10 includes at least two inflection points I1, I2. Preferably, the number of inflection points I1, I2 can be even so as to maintain the general orientation of the leading edge 11 and of the trailing edge 12 with respect to the flow, and therefore to preserve the cross-section at the throat. Moreover, according to one embodiment, the corresponding camber line 15 extends here between the intrados wall 14 and the chord 16, so that, at every point between the leading edge 11 and the trailing edge 12, the camber line 15 and the intrados wall 14 extend remotely from the chord 16, and the concave areas of the extrados wall 13 cross the chord 16.

The invention claimed is:

1. A diffuser of a radial or mixed-flow compressor of an engine including a vane of a diffuser for a radial or mixed-flow compressor of an engine, including a leading edge positioned facing a gas flow, a trailing edge opposite to the leading edge, an extrados side wall and an intrados side wall which connect the leading edge to the trailing edge, the vane including a profile having a camber line with at least two inflection points between the leading edge and the trailing edge, the vane being characterized in that a curve of the intrados side wall and a curve of the extrados side wall substantially follow a curve of the camber line, so that:

the intrados side wall includes, between the leading edge and the trailing edge, at least two convex parts separated by a concave part, and the extrados side wall includes, between the leading edge and the trailing edge, at least two concave parts separated by a convex part, and in that the profile defines a chord which extends between the leading edge and the trailing edge, and the convex parts of the intrados side wall and the concave parts of the extrados side wall extend at least partially on a same side of said chord.

2. A radial or mixed-flow compressor of an engine, including a vane of a diffuser for a radial or mixed-flow compressor of an engine, including a leading edge positioned facing a gas flow, a trailing edge opposite to the leading edge, an extrados side wall and an intrados side wall which connect the leading edge to the trailing edge, the vane including a profile having a camber line with at least two inflection points between the leading edge and the trailing edge, the vane being characterized in that a curve of the intrados side wall and a curve of the extrados side wall substantially follow a curve of the camber line, so that:

the intrados side wall includes, between the leading edge and the trailing edge, at least two convex parts separated by a concave part, and the extrados side wall includes, between the leading edge and the trailing edge, at least two concave parts separated by a convex part, and in that the profile defines a chord which extends between the leading edge and the trailing edge, and the convex parts of the intrados side wall and the concave parts of the extrados side wall extend at least partially on a same side of said chord.

3. An engine, including a radial or mixed-flow compressor according to claim 2.

4. The diffuser according to claim 1, wherein at every point between the leading edge and the trailing edge, said chord extends remotely from the camber line.

5. The diffuser according to claim 1, wherein the at least two inflection points are located between 10% and 90% of said chord.

6. The diffuser according to claim 5, wherein a first of said at least two inflection points is located between 35% and 55% of the chord, and a second of said at least two inflection points is located between 55% and 65% of said chord.

7. The diffuser according to claim 1, including an angle of attack comprised between 0° and about 45° which corresponds to an angle between a tangent to the camber line at the leading edge and the chord.

8. The radial or mixed-flow compressor according to claim 2, wherein at every point between the leading edge and the trailing edge, said chord extends remotely from the camber line.

9. The radial or mixed-flow compressor according to claim 2, wherein the at least two inflection points are located between 10% and 90% of said chord.

10. The radial or mixed-flow compressor according to claim 9, wherein a first of said at least two inflection points is located between 35% and 55% of the chord, and a second of said at least two inflection points is located between 55% and 65% of said chord.

11. The radial or mixed-flow compressor according to claim 2, including an angle of attack comprised between 0° and about 45° which corresponds to an angle between a tangent to the camber line at the leading edge and the chord.

* * * * *